United States Patent [19]

Thurlow

[11] 4,327,128

[45] Apr. 27, 1982

[54] TRANSFER COATING METHODS, COMPOSITIONS AND PRODUCTS

[75] Inventor: John F. Thurlow, Gorham, Me.

[73] Assignee: Dennison Manufacturing Company, Framingham, Mass.

[21] Appl. No.: 101,346

[22] Filed: Dec. 7, 1979

[51] Int. Cl.[3] ..... B41M 3/12

[52] U.S. Cl. ..... 427/153; 427/146; 427/395; 427/411; 427/416; 427/417; 427/418; 427/419.1; 427/419.5; 427/419.8; 428/914

[58] Field of Search ..... 427/153, 416, 146, 395, 427/411, 417, 418, 419.1, 419.5, 419.8; 428/914

[56] References Cited

U.S. PATENT DOCUMENTS

| | | | |
|---|---|---|---|
| 2,022,276 | 11/1935 | Dixon et al. | 427/153 |
| 2,188,590 | 1/1940 | Bjorksten et al. | 427/153 |
| 3,017,297 | 1/1962 | Newman et al. | 427/153 |
| 3,111,421 | 11/1963 | Newman et al. | 427/153 |
| 3,301,697 | 1/1967 | Russell | 427/146 |
| 3,418,148 | 12/1968 | Barz | 427/146 |
| 3,468,692 | 9/1969 | Winzer | 427/153 |
| 3,539,376 | 11/1970 | Otani et al. | 427/153 |
| 3,922,438 | 11/1975 | Brown et al. | 427/146 |
| 4,087,580 | 5/1978 | McElligott et al. | 427/153 |
| 4,103,053 | 7/1978 | Barehas | 427/146 |

FOREIGN PATENT DOCUMENTS

| | | | |
|---|---|---|---|
| 664790 | 6/1963 | Canada | 427/153 |

*Primary Examiner*—Norman Morgenstern
*Assistant Examiner*—Janyce A. Bell
*Attorney, Agent, or Firm*—George E. Kersey

[57] ABSTRACT

Coating methods and compositions for products and transfer media, such as carbon papers, in which a preliminary coating of liquid-dispersed colorant, such as carbon black, is applied at a first stage followed by a transfer overcoating at a second stage. The multistage coating procedure affords the threefold benefits of (1) improved image transfer properties in the product; (2) a reduced tendency of the product to smudge; and (3) less than the conventional amount of transfer materials for a specified result being required.

27 Claims, 6 Drawing Figures

FLOW CHART

FLOW CHART

TRANSFER COATING METHODS, COMPOSITIONS AND PRODUCTS

BACKGROUND OF THE INVENTION

This invention relates to the transfer of impressions from one surface to another by the use of coatings. More particularly, the invention relates to improved transfer images obtained employing a lower concentration of transfer materials than would normally be required in prior art coating processes for obtaining the same desired result.

Heretofore carbon papers have been made primarily by applying to a flexible foundation a single layer of a coating composition comprised of waxes or wax-like materials to which a colorant or blend of colorants had been added. Additional materials could be added to the coating mixture when special properties were desired. The ensuing mixture is then generally applied to a substrate such as paper either in molten form or in solution with one or more organic solvents. In the case of a paper substrate the resulting product is commonly known as carbon or transfer paper. The product is also known as "one-time" carbon paper when it is intended for a single use.

The usual manufacturing procedure is relatively slow, requires special equipment for the application of organic solvent coatings or molten coatings and may result in the application of relatively thick coatings to the substrates. Such coatings may be unsatisfactory where the transfer medium is to be used in producing a large number of copies and in any case may produce images of less sharp definition than where lighter and/or harder coatings are employed. Moreover, such waxy colored coatings have a tendency to smudge the hands and also the underlying copy papers. In addition, when the coating is relatively thick it represents a significant cost factor. The constituents of the coating have been the subject of demand pressure, which in view of supply shortages, has given rise to a continuously increasing element of overall cost.

Various attempts have been made to solve at least some of the above-identified problems as exemplified by U.S. Pat. No. 2,931,752 issued Apr. 5, 1960. According to this prior art teaching, a transfer layer is employed in which the color carrying material is primarily water-insoluble wax but which is of such a nature that it can be spread directly from a water dispersion rather than being applied in a molten condition with attendant temperature control problems. Although at the time, the teachings of this patent represented a significant advancement over the prior art, the coatings used in accordance with this patent are costly and are now in short supply. In addition, and most significantly, these same coatings demonstrate reduced image definition by comparison with standard coatings of comparable thickness.

Aqueous coatings have also been used in the production of donor-receptor copy papers to provide what is commonly known as "mated" systems. One example is U.S. Pat. No. 3,635,747. Not only are there the disadvantages and waste of the mated system, the transfer images again, tend to have reduced definition.

Similarly in Swiss Pat. No. 465,386 and German Pat. No. 1,421,444 the use of aqueous coatings is accompanied by production and technical disadvantages as well as a failure to obtain the desired image definition.

Ideally, a method of coating substrates whereby the problems of reduced transfer image definition and smudging are eliminated but which at the same time affords a product of potentially lower cost would be beneficial to both the industry and consumer at large.

Accordingly, it is the principal object of the immediate invention to provide a method of coating transfer media such that the resultant transfer image is well-defined and demonstrates an improved quality over the transfer image obtained from conventionally-coated transfer media.

Another object of the present invention is to reduce the amount of wax and/or wax-like materials needed in the manufacture of transfer coatings.

It is a further object of the present invention to prepare transfer media to the carbon paper type which are cleaner to the touch and which pressure-release images are more smudge-resistant than those heretofore known.

Yet another object of this invention is to produce a one-time carbon paper which is lighter in weight than conventional one-time carbon paper.

The above and additional objects of this invention, which will be more readily apparent on reviewing the ensuing disclosure, are accomplished in accordance with the following summary.

SUMMARY OF THE INVENTION

When a mixture of hot wax and pigment is coated on paper according to the conventional one-step process, it has been theorized that a large amount of this transfer material penetrates the paper and is therefore not available for transfer purposes. This accounts at least in part for the inferior quality of some transfer images.

It has been found that the foregoing difficulty can be substantially alleviated by employing a multistage method of coating the transfer materials onto the transfer medium.

The multistage process desirably involves the use of two coatings, of which the first coating is advantageously in the form of a thin layer of dispersed colorant, with or without inorganic extenders. The second coating is a thin supplemental layer of wax and/or wax-like materials, also with or without inorganic extenders, applied at a second station of processing. This procedure surprisingly results in a composite coating which produces better impressions than a comparable coating containing the same concentration of transfer materials applied according to prior art techniques.

Thus, the invention provides a method for improving transfer images in the case of transfer media such as carbon paper while at the same time necessitating smaller amounts of the transfer materials themselves. Specifically, and by contrast with the prior art, the present invention permits the usage of as little as one-quarter pound of colorant coating for each three thousand square feet of transfer medium with the overcoating being present in as small an amount as an additional one-half pound per three thousand square feet of treated surface. The colorant coating desirably is in the range from about 0.25 pounds to about 1 pound preferably 0.5 per 3000 square feet of substrate, and the overcoating is desirably present in the range from about 0.5 to to about 1.5 pounds preferably 1.5 per 3000 square feet of substrate.

According to one mode of the present invention, it is possible to have as little as three-quarter pound of coating per three thousand square feet of transfer medium to derive a specified result in contrast to the prior art coated papers which employ at least two and often times as much as three pounds of coating per three thousand square feet of transfer medium to obtain the same result.

DESCRIPTION OF THE DRAWINGS

Other aspects of the invention will become apparent after considering several illustrative embodiments taken in conjunction with the drawings in which.

DETAILED DESCRIPTION

Figure 1:
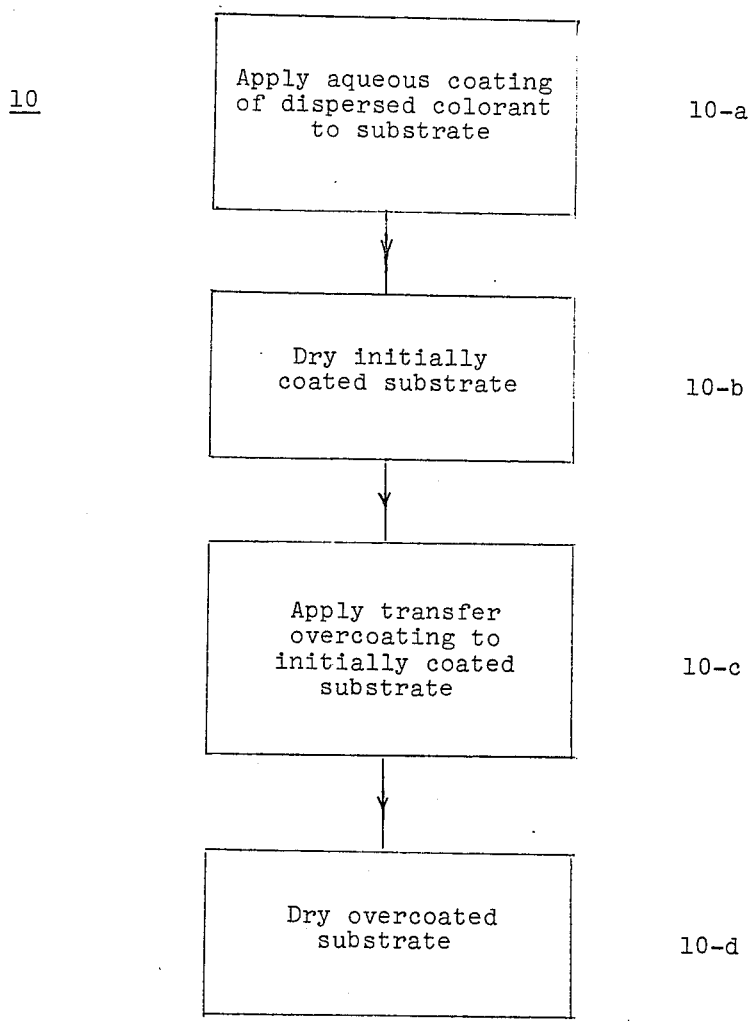
FIG. 1 is a flow chart for practicing the invention.

As hereinbefore indicated, the initial or preliminary coating to be applied consists basically of an aqueous dispersion of a colorant or mixture of colorants, the choice of colorant(s) being limited mainly by the color of the image transfer desired. Thus, by way of illustration, colorants which may be used are any of the carbon blacks which lend themselves to dispersion in water, water-insoluble pigments, water-soluble dyes, a clay slurry, a wax dispersion, a combined clay-wax dispersion, or the like. However mainly for reasons of economy, carbon blacks are the preferred materials where it is desired to produce a black transferred image. If the carbon black is not accompanied by its own dispersal agent, a suitable agent such as tetrasodium pyrophosphate may be added.

The second or overlaying coating consists basically of an aqueous dispersion of wax or wax-like materials. Thus, waxes or wax-like materials appropriate for use in this invention are those materials for which water dispersions can be prepared either as a separate dispersion or in conjunction with other ingredients of the aqueous coating composition. Illustrative of these materials are the so-called natural waxes of plant or animal origin such as bees wax, carnauba wax, candelilla wax, etc. or the hydrocarbon-based materials such as paraffins, micro crystalline waxes, low molecular weight polyolefins, montan wax, etc. one or more of which petroleum-based products are or have been made commercially available either in undispersed or water dispersion form. Additional materials appropriate for use in the present invention are the metal salts of fatty acids of at least 11 carbon atoms and preferably of 18 carbon atoms such as the stearates, oleates or linoleates of zinc, calcium, barium, magnesium, aluminum and zirconium one or more of which are or have been made available commercially. The waxy product is desirably an emulsion. If not emulsified, the wax is desirably combined with an emulsifier such as oleic acid or triethanolamine.

Just as one selects the colorant according to the desired color of the image transfer, one selects a hard or soft wax or wax-like material depending on the quality of distinctness and intensity being sought. A paraffin wax, due to its softness, is usually less satisfactory in the practice of this invention than is a harder wax such as a Montan wax or low-molecular weight polyethylene. On the other hand the hardest waxes or wax-like products (such as zinc stearate) may not transfer, under stylus or typewriting pressures, in amounts sufficient for an adequate image unless small amounts of softer waxes or adhesive compounds are included.

As mentioned previously, the colorant and/or the wax, wax-like materials may be employed with or without inorganic extenders. Appropriate extenders for use in this invention are any of the fine-particle inorganic materials which can be readily dispersed in low viscosity carrier fluids such as water. For example, clay, calcium carbonate, titanium dioxide or the like may be employed. Illustrative of the clays which may be employed are any of the grades of clay used in the aqueous coating of paper such as those made available commercially by Georgia Kaolin Co., Elizabeth, N.J., Anglo American Clays Corp., South Atlanta, Ga., and Freeport Minerals Co., New York, N.Y. to name just a few. Similarly, appropriate grades of titanium dioxide are also those used in the aqueous coating of paper which are readily available commercially. Lastly, any grade of calcium carbonate, whether ground from limestone or synthesized by precipitation such as those used in the aqueous coating of paper. However, mainly from a cost savings standpoint, a clay or mixture of appropriate clays is preferably employed as the extender material.

In a preferred embodiment of this invention, an extender or filler material replaces a substantial amount of, and extends, the wax or wax-like material which ordinarily forms the principal part of the transfer coating which has been shown to provide improved transfer characteristics according to pending U.S. patent application Ser. No. 817,767 herein incorporated by reference. According to the above-identified patent application the coating is prepared as a dispersion of the filler or extender, with wax or wax-like material and colorant, in a low viscosity medium such as water. However, since the essence of the present invention rests in applying the colorant and wax materials separately, it will be appreciated that all of the filler may be placed with the colorant, or all with the wax materials, or the filler may be present in each coating composition, provided that the total of the combined filler concentrations in no instance exceeds the recommended total filler concentration of the above-identified patent application. Thus, in accordance with the referenced application, the amount of colorant can range from 5 to 25 parts for each 100 parts of extender, while the amount of wax can range from 10 to 40 parts.

Where the colorant is carbon black, or other insoluble material, it is preferably used without any extender material; however, where the colorant is a dye, the preferred amount of colorant is 15 parts per 100 parts of extender material. For colorant beyond 15 parts to approximately 30 parts the transfer images become increasingly dispersed as the amount of colorant increases. Conversely, for colorant below 15 parts per 100 parts of extender, as low as 2.5 parts per 100 parts of extender the transfer images have a progressively reduced density such that 2.5 parts per 100 represents the threshold of acceptable transfer performance.

The preferred amount of wax is 20 parts per 100. The amount of wax may be reduced to as low as 10 parts per 100 which reduced the density of the transfer and it may be increased to as much as 40 parts per hundred which increases the density of the transfer. For wax in excess of 40 parts per hundred, not only is the amount of transfer excessive, but it represents a wasteage of the wax. Conversely, for amounts below 10 parts per hundred of wax the amount of material deposited in the transfer is inadequate for good copy.

It will be appreciated that although mention has not been made thusfar concerning the presence of additional non-essential ingredients, minor amounts of additives such as defoamers, humectants, viscosity modifiers, water-proofing agents and the like may be employed in either or both coatings in commercial practice for convenience in mixing and/or coating. The use of any of these minor additives is dependent on the nature of the mixing and coating equipment. Except for the pigment dispersant required to assure ease and completeness of dispersion of the clay or colorant particles none of these minor additives are considered vital to the practice of this invention.

In selecting the proportions of ingredients one is guided by the nature of the available coating equipment, by the specifications for the final product and by allowable costs, all of which are readily determined by one skilled in the art.

It will be understood that while it is advantageous for the dispersed colorant to be confined to the first coating where an anti-smudge characteristic, colorant may be included in the overcoating, confined to it, or distributed in different hues in the two coatings, according to the particular application desired.

In the practice of the invention according to the Flow Chart 10 of FIG. 1, the colored dispersion is applied in step 10-a by spray, roll coater or blade coater to one side of the fully or partially dried substrate paper, which conventionally is the usual unbleached kraft tissue manufactured for the production of commerical one-time carbon paper. A white or semibleached sheet may, if desired, be used.

In the second process step 10-b the web thus coated, in continuous process, is passed through conventional drying equipment to remove at least most of the water vehicle.

In the third process step 10-c, the aqueous dispersion containing wax and/or wax-like ingredients, with or without inorganic extenders, is applied immediately to the colorant-coated substrate at the second coating station.

In the fourth process step 10-d the web thus coated with the second coating is immediately passed through conventional drying equipment to remove the water vehicle.

The coatings prepared in accordance with this invention can be applied to a substrate, such as paper stock, in a wide variety of ways. However, the coatings are advantageously applied in conjunction with, or as an adjunct to, the standard manufacture of paper, using trailing blade coaters 20A through 20E illustrates in FIGS. 2A through 2E. Such coaters are formed by a backing roll 21 which is covered by an elastomer such as rubber with an illustrative hardness of 70 (P and J). The backing roll 21 advantageously has a finished diameter of between 30 and 36 inches. The paper web 22 to be coated has a wrap of between approximately 90° and 180° around the roll 21, depending on the web, which is adjustably driven by fly rolls 23 with respect to the remainder of the coating machinery (not shown). The backing roll 21 is accompanied by a coating head or chamber 24*a* through 24*c* in the case of FIGS. 2A through 2C, and by rolls 24*d* and 24*e* in the case of FIGS. 2D and 2E. Blades 25*a* and 25*b* are used with the chambers 24*a* and 24*b* of FIGS. 2A and 2B, and blades 25*c* through 25*e* are used beyond the point of coating contact in FIGS. 2C through 2E.

Figure 2A:
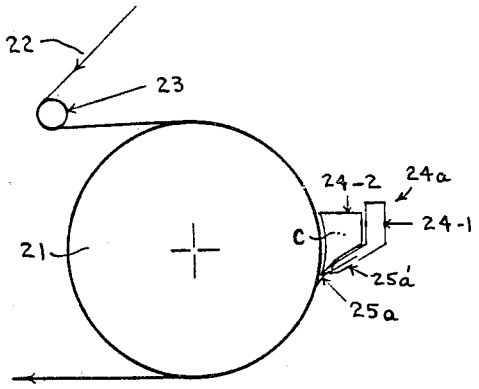
FIGS. 2A, 2B, 2C, 2D and 2E are illustrative of blade coaters favored in the practice of this invention. However, any types of aqueous coaters which will deliver a sufficiently pattern-free coated surface will suffice for application of both the first and the overlaying coating.
Figure 2B:
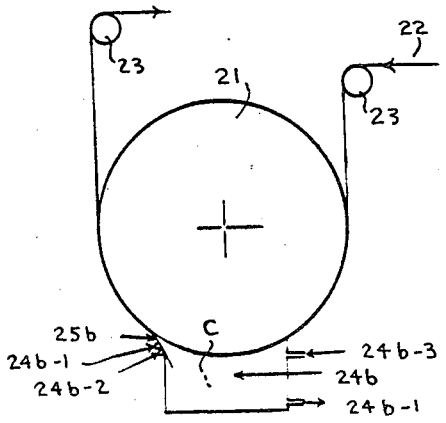
Figure 2C:
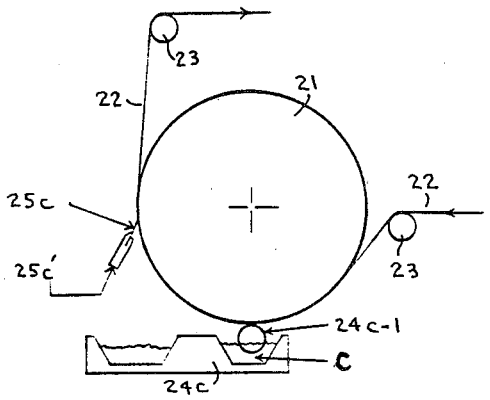

In FIG. 2A the coating head 24*a* is formed by a frame 24-1 with end retainers of which one retainer 24-2, also known as a "dam" is visible. The blade 25*a* serves as an extension of the frame 24-1 into engagement with the web 22. The blade 25*a* is held in place by releasable jaws. Once the blade has been adjusted, the chamber 24*a* is filled with a coating composition C prepared in accordance with the flow chart of FIG. 1.

Where it is important to be able to change blades quickly the "enclosed pond" coater 20B of FIG. 2B is employed. In this coater the coating composition C is enclosed in a chamber 24*b*. A blade 25*b* is held in place by pressurized plastic tubes 24*b*-1 and 24*b*-2. The blade 25*b* is easily changed by releasing the pressure in the tubes 24*b*-1 and 24*b*-2. The coating C enters the chamber 24*b* at an inlet 24*b*-3 and is removed at an outlet 24*b*-4.

Where it is important to start and stop the coating operation quickly, the "flooded nip" coater 20C of FIG. 2C is employed. This coater has a chamber 24*c* with an applicator roll 24*c*-1 that permits quick starts and stops. The blade 25*c* of FIG. 2C has an upside down configuration similar to that of FIG. 2B.

Figure 2D:
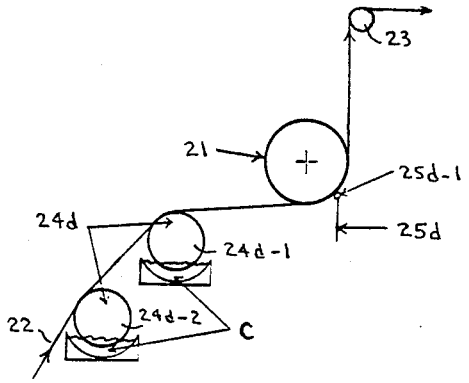

Another suitable coater for the practice of the invention is of the "flex" type as shown in FIG. 2D. This coater uses one or more applicator rollers, with two such rolls 24*d*-1 and 24*d*-2 in FIG. 2D, without backing rolls. In addition the blade 25*d* is a modification of what is shown in FIGS. 2A through 2C. The blade 25*d* of FIG. 2D makes use of a revolving rod 25*d*-1 at the point of contact with the web on the backing roll 21. The rod revolves against the direction of web travel thus smoothing the coating on the sheet. The reverse direction of rotation of the rod 25*d*-1 also increases the flood action in the nip and reduces the number of streaks and scratches that appear in the coating. The thickness of the coating is determined by the pressure of the blade 25*d* against the web and by the diameter of the revolving rod 25*d*-1.

Figure 2E:
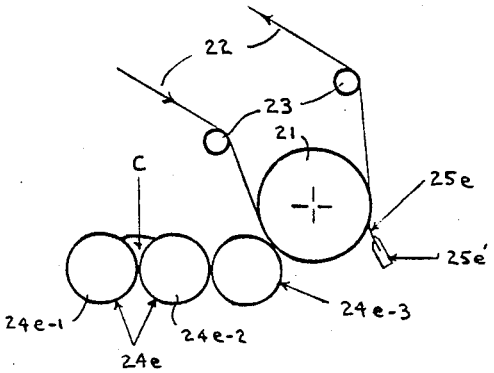

Another coater that can be used in the practice of the invention is the coater 20E in FIG. 2E. Like the coater of FIGS. 2B and 2C, the coater 20E uses an inverted blade 25*e*. This provides a flushing action that keeps the nip clean. To apply the coating the material is disposed at the nip of two gate rolls 24*e*-1 and 24*e*-2. It is carried from the second gate roll 24*e*-2 to a transfer roll 24*e*-3 and applied to the web before the blade 25*e*. The weight of the coating is controlled by the position of the blade against the web. One technique for controlling the blade is by the use of air cylinders which move the blade relative to its holder. Like the flooded nip coater of FIG. 2C, the transfer roll coater of FIG. 2E is able to start and stop rapidly.

It will be appreciated that the various features of the coater shown in FIGS. 2A through 2E may be combined in a variety of ways.

In order that the present invention be more clearly understood, reference will now be made to the following examples directed mainly to the preparation and use of the preferred embodiment of this invention, but said examples are not to be construed as limiting in any sense.

EXAMPLE I

One hundred (100) parts of finely divided clay are dispersed in a water medium. The clay mixture is divided into two equal portions. To one portion is added 20 parts of finely divided wax in the form of carnauba wax and the two ingredients blended thoroughly in a ball or colloid mill. To the remaining portion of clay dispersion is added 15 parts of colorant in the form of carbon black under continued agitation until a uniform dispersion of colorant and clay is obtained. The colorant/clay coating mixture is then spread using a trailing blade coater on a roll of paper being processed by a paper making machine. After the coating is substantially dried, the clay/wax mixture is spread onto the clay/-colorant-coated paper using the same method as employed previously. After the second coating is suitably dried, the resultant product gives transfer impressions superior to those obtained where the clay, colorant and wax are applied in a single coating operation.

EXAMPLE II

Example I is repeated except that the colorant is 25 parts of colorant. The resulting transfer impressions are better defined than in Example II.

EXAMPLE IV

Example I is repeated except that the colorant is 30 parts of carbon black. The resulting transfer impressions represent an improvement over a comparable one-coat system but are more dispersed than the images of Example III.

EXAMPLE V

Example I is repeated except that the colorant is 15 parts of carbon black. The resulting transfer impressions are less dense than those of Example I.

EXAMPLE VI

Example I is repeated except that the colorant is 10 parts of carbon black. The resulting transfer impressions are less dense than those of Example V.

EXAMPLE VII

Example I is repeated except that the colorant is 5 parts of carbon black. The resulting transfer impressions are less dense than those of Example VI.

EXAMPLE VIII

Example I is repeated except that the colorant is 2.5 parts of carbon black. While the transfer impressions are satisfactory, the impressions obtained from the comparable one-coat system are at the lower threshold of acceptability.

EXAMPLE IX

Example I is repeated except that microwax is substituted for carnauba wax.

EXAMPLE X

Example I is repeated except that calcium carbonate is substituted for clay. The resultant product gives transfer impressions superior to those obtained when the ingredients are applied in a single coating operation.

EXAMPLE XI

Example I is repeated except that titanium dioxide is substituted for clay. The resultant product gives transfer impressions superior to those obtained when the ingredients are applied in a single coating operation.

EXAMPLE XII

Twenty (20) parts of colorant in the form of carbon black are dispersed in a water medium, and seventy (70) parts of finely divided wax of petroleum origin are dispersed in a separate, second water medium. The colorant dispersion is applied to a paper substrate, followed by application and drying of the wax dispersion. The resultant product gave transfer impressions that were superior to those obtained when the ingredients are applied in a single coating operation.

EXAMPLE XIII

Example XII is repeated except that the second dispersion is formed by fifty (50) parts finely divided clay and twenty (20) parts wax. The resultant product gives transfer impressions superior to those obtained when the ingredients are applied in a single coating operation.

EXAMPLE XIV

Fifteen (15) parts of carbon black are mixed with 60 parts of clay and the mixture dispersed into water and milled until the dispersion is smooth and uniform. A second and separate coating mixture containing 20 parts of wax-like material in the form of a petroleum derivative and forty (40) parts of clay is dispersed in water and milled until the dispersion is smooth and uniform. The first coating mixture is applied to a roll of paper using a trailing blade. After the coating is substantially dried, the second coating mixture is applied in the same fashion and similarly dried. The same improved quality of the transfer impressions over comparable one-coat systems was noted as in Example I.

EXAMPLE XV

Example XIV is repeated three different times employing first 10 parts wax, then 30 parts and then 40 parts wax. The results are all satisfactory with the density of Example XVIII being reduced where 10 parts wax are employed; the density of the same increased with the use of 30 parts wax; and the density being satisfactory where as high as 40 parts wax are employed but the comparable one-stage coating system demonstrating a threshold level of acceptance at the 40 parts wax concentration.

EXAMPLE XVI

Fifteen (15) parts of carbon black and 100 parts of clay are dispersed in a water medium. Thirty (30) parts of wax in the form of calcium stearate are separately dispersed in a water medium. The carbon black coating mixture is spread using a trailing blade coater on a roll of paper being processed by a paper making machine. After the coating is substantially dried, the wax coating is similarly applied and dried. Improved results are noted.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention are set forth in the appended claims.

What is claimed is:

1. The method of coating a substrate for the transfer of impressions which comprises applying two coatings to said substrate wherein:

(a) one of the coatings is wax-free and contains colorant, (b) the other of the coatings is continuous and includes wax or wax-like material as the only organic ingredient, thereby to provide greater image definition and intensity than coating alone.

2. The method of claim 1 wherein said one coating is uniformly dispersed on said substrate in the range from 0.25 to 1 pound per three thousand square feet of substrate and said other coating is present in the range from 0.5 to 1.5 pounds per three thousand square feet of substrate.

3. The method of claim 2 wherein said one coating is present to the extent of 0.5 pounds per three thousand square feet and said other coating is present to the extent of 1.5 pounds per three thousand square feet, thereby to produce a sharper transfer image than can be achieved using the same total percentage of coating in a single coating application.

4. The method of claim 1 wherein said one coating contains a colorant and said other coating does not.

5. The method of claim 1 wherein said colorant is distributed between the two coatings.

6. The method of claim 1 wherein the colorant is a dispersion of carbon black and an inorganic solvent.

7. The method of claim 6 wherein said inorganic solvent is water.

8. The method of claim 1 wherein said other coating is a dispersion in water of wax or wax-like material.

9. The method of claim 1 wherein at least one of the coatings includes an inorganic extender.

10. The method of claim 9 wherein each of said coatings includes an inorganic extender.

11. The method of claim 9 wherein the inorganic extender is clay, calcium carbonate, or titanium dioxide to whiten and harden the outer layer of the coated product.

12. The method of coating a substrate for the transfer of impressions, which comprises (a) applying a first coating to said substrate containing only a colorant, and (b) applying a second coating to said substrate containing only a wax-like material selected from the class consisting of natural waxes of plant or animal origin, hydrocarbon based materials such as paraffins, microcrystalline waxes and low molecular weight polyolefins, and metallic salts of fatty acids of at least eleven carbon atoms including stearates, oleates, or linoleates.

13. The method of coating a substrate for the transfer of impressions, which comprises (a) applying to the substrate a first coating containing only a colorant and an inorganic filler material;

(b) applying a second coating, overlying the first coating, containing only a wax-like material and an inorganic filler material; thereby to provide a transfer medium that produces greater image definition and intensity than for a single coating of the ingredients having their combined thickness.

14. The method of claim 12 or 13 wherein said first coating is uniformly dispersed on said substrate in the range from 0.25 to 1 pound per three thousand square feet of substrate and said second coating is present in the range from 0.5 to 1.5 pounds per three thousand square feet of substrate.

15. The method of claim 14 wherein said first coating is present to the extent of 0.5 pounds per three thousand square feet and said second coating is present to the extent of 1.5 pounds per three thousand square feet, thereby to produce a sharper transfer image than can be achieved using the same total percentage of coating in a single coating application.

16. The method of claim 13 wherein said inorganic filler material is clay, calcium carbonate, or titanium dioxide.

17. The method of claim 13 wherein said inorganic filler material is finely divided clay which is initially dispersed in a water medium and then divided into two equal portions, with one portion being supplemented by finely divided wax and blended thoroughly, and the remaining portion being supplemented by colorant under continued agitation until a uniform dispersion of colorant and clay is obtained with both portions being applied and subsequently dried.

18. The method of claim 17 wherein the colorant/-clay coating mixture is spread using a trailing blade coater on a roll of paper being processed by a paper making machine, and after the coating is substantially dried the clay/wax mixture is spread onto the clay/-colorant coated paper using said trailing blade coater.

19. The method of claim 17 wherein 20 parts of wax are added to each 100 parts of finely divided clay and 15 parts of colorant are thereafter added.

20. The method of claim 19 wherein the amount of colorant is in the range from about $2\frac{1}{2}$ parts to about 30 parts.

21. The method of claim 12 wherein 20 parts of colorant are dispersed in a first water medium and 70 parts of finely divided wax are dispersed in a second water medium, the dispersions being applied and subsequently dried.

22. The method of claim 21 wherein the colorant dispersion is applied to a paper substrate followed by application and drying of the wax dispersion.

23. The method of claim 17 wherein the second dispersion is formed by 50 parts of finely divided clay and 20 parts of wax.

24. The method of claim 23 wherein the amount of finely divided clay is in the range from about 20 to 40 parts.

25. The method of claim 12 or 13 wherein the amount of wax is in the range from 10 parts to 40 parts for each 100 parts of medium.

26. The method of claim 12 wherein the first coating material is initially dispersed in an aqueous solvent and is thereafter dried.

27. The method of claim 12 or 13 wherein said wax-like material is applied as a dispersion in water and is subsequently dried.

* * * * *